US008617637B2

(12) United States Patent
Morimoto et al.

(10) Patent No.: US 8,617,637 B2
(45) Date of Patent: Dec. 31, 2013

(54) PLASMA SPRAY COATING METHOD

(75) Inventors: Hitoshi Morimoto, Hyogo (JP); Yoriaki Inoue, Hyogo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 300 days.

(21) Appl. No.: 12/991,905

(22) PCT Filed: Jun. 25, 2008

(86) PCT No.: PCT/JP2008/061941

§ 371 (c)(1),
(2), (4) Date: Dec. 15, 2010

(87) PCT Pub. No.: WO2009/157093

PCT Pub. Date: Dec. 30, 2009

(65) Prior Publication Data

US 2011/0104382 A1 May 5, 2011

(51) Int. Cl.
*C23C 4/00* (2006.01)
*B05D 3/06* (2006.01)

(52) U.S. Cl.
USPC ..... 427/8; 427/446; 427/453; 427/454; 427/516

(58) Field of Classification Search
USPC ..... 427/8
See application file for complete search history.

(56) References Cited

U.S. PATENT DOCUMENTS 4,592,922 A 6/1986 Lewis
5,902,647 A * 5/1999 Venkataramani et al. .... 427/454

FOREIGN PATENT DOCUMENTS

CN 102046831 A 5/2011
JP 4-107252 A 4/1992
JP 5-111666 A 5/1993
JP 2977369 B2 11/1999
JP 3067416 B2 7/2000

OTHER PUBLICATIONS

International Search Report of Application No. PCT/JP2008/061941 mailed Aug. 12, 2008.
The English translation of the International Preliminary Report on Patentability issued in corresponding application PCT/JP2008/061941 on Feb. 17, 2011.
European Search Report for EP08765865.4, dated Oct. 14, 2011.
Office Action as issued on Jan. 29, 2012, in corresponding Chinese Application No. 200880129451.8—Chinese Language Version.
Office Action as issued on Jan. 29, 2012, in corresponding Chinese Application No. 200880129451.8—English Language Version.
Notice of allowance effective Apr. 16, 2013, issued to the corresponding Chinese application No. 200880129451.8, with English Translation.

(Continued)

*Primary Examiner* — Katherine A Bareford
(74) *Attorney, Agent, or Firm* — Kanesaka Berner & Partners, LLP

(57) ABSTRACT

A thermal spraying method includes forming a coating layer of heat resistant resin on the whole spray area of the metal surface, securely fixing a test piece of the same material as that of the metal as a constituent of heat resistant equipment on the surface of the coating layer, spraying a heat shield coating material onto the test piece, detaching the test piece from the surface of the coating layer, inspecting the condition of spray and setting spray conditions, removing the coating layer and, under the above set spray conditions, spraying the heat shield coating material onto the metal surface to thereby form a heat shield coating layer.

4 Claims, 4 Drawing Sheets

(56) References Cited

OTHER PUBLICATIONS

Notice of allowance effective Jan. 3, 2013, issued to the corresponding Korean application No. 2010-7026614, with English Translation.

Notice of allowance effective May 6, 2013, issued to the corresponding European application No. 08765865.4.

Decision to Grant as dated Sep. 11, 2013, in Japanese Application No. 2010-517652, with english translation.

* cited by examiner (A)

(B)

PLASMA SPRAY COATING METHOD

RELATED APPLICATIONS

The present application is based on and claims priority from International Application Number PCT/JP2008/061941, filed Jun. 25, 2008, the disclosure of which is hereby incorporated by reference herein in its entirety.

BACKGROUND OF THE INVENTION

1. Field of the Invention

The present invention relates to a method for forming plasma-sprayed thermal barrier coatings over the surfaces of the metal bodies such as the combustor transition pieces, turbine rotor blades, and turbine stator blades as to the industrial gas turbines.

2. Background of the Invention

Gas turbines are used for the emergency power generating facilities, as the gas turbines need neither cooling water nor long start-up time; gas turbines are used for the combined cycle power plants (gas-turbine steam-turbine combined cycle power plants) of a large scale because of the high efficiency of the combined cycle power generation.

The gas turbine is a centrifugal, axial or radial turbo machine that includes three major configuration parts, namely, a compressor, a combustor, and a turbine. In the gas turbine, the air compressed by the compressor is supplied to the combustor(s) in which the fuel is injected so as to be burnt; thereby, the combustion gas of a high temperature and a high pressure is generated; and, the combustion gas flows into the centrifugal, axial or radial turbine so as to drive the gas turbine (so as to make the gas turbine rotate). In general, the turbine is directly connected (without gear connections) to the compressor, transferring the power needed for compressing the air to be supplied to the compressor.

In order to improve the efficiency of the gas turbine, it is desirable to enhance the turbine inlet temperature (TIT); thus, TIT has been increased in the field of the gas turbine. The TIT for the gas turbines operated in the actual thermal power plants is usually at a level within a range around from 1300 to 1500° C.

The parts that form the combustor, the combustor transition piece that guides the high temperature/pressure combustion gas from the combustor to the turbine, the turbine rotor blades, and the turbine stator blades are exposed to the combustion gas of the temperature around from 1300 to 1500° C.; these gas turbine components are provided with the thermal barrier coatings (often abbreviated as TBC) so as to achieve high durability. For instance, the patent reference 1 (JP patent 2977369) discloses a rotor or stator blade with the surface TBC comprising a first layer that is made of NiCrAlY (nickel.chrome.aluminum.yttrium) alloy or CoNiCrAlY (cobalt-.nickel.chrome.aluminum.yttrium) alloy, the layer being formed by means of the low pressure plasma spray coating; a second layer that is made of $ZrO_2$-$Y_2O_3$ material, the layer being formed by means of the atmospheric pressure plasma spray coating; a third layer that is made of fine ceramics and forms oxygen-permeable layer, the layer being formed by means of the chemical vapor deposition or the low pressure plasma spray coating.

In forming the TBC on the parts configuring the gas turbine as described in the above, a robot comprising a plasma spray gun is used in order that the coating material is sprayed from the spray gun toward the to-be-coated surface or the whole surface of the to-be-coated part in response to the predetermined plasma spray conditions, while the robot is moved toward a predetermined direction at a predetermined speed. The referred plasma spray conditions depends on the shape, the to-be-coated part material and so on; thus, before performing the spray coating by use of the robot, it becomes necessary to instill (teach) how to spray plasma coating in (to) the robot. It is hereby noted that the term "(robot) teaching" mean to teach the robot how to move and work hereafter in this specification.

The conventional robot teaching for establishing the plasma spray coating conditions is a manner in which a test plasma spray coating is performed to a to-be-spray-coated part, and the inspection of the coated part is executed, on the premise that the part is inexpensive; namely, if the inspection result is negative (not satisfactory), the same process (modified coating test on an equivalent part) is repeated until the inspection result becomes satisfactory. In other words, the tested parts until the inspection result becomes satisfactory are thrown away.

In a case where the to-be-spray-coated part is expensive, the robot teaching method in which the throwaway practice as described above is incorporated is not feasible from the economical point of view; in fact, the above referred parts such as the combustor transition pieces, turbine rotor blades, and turbine stator blades are the examples of expensive parts. In particular, the combustor transition pieces are made of the expensive Ni-base alloy as the patent reference 2 (JP patent 3067416) discloses; further, the transition pieces are provided with a plurality of fine through-holes for cooling the combustion gas flow film (boundary layer), the fine holes being not easily machined; and, the manufacturing cost of the combustor transition pieces currently reach several millions yen per gas turbine. Therefor, the robot teaching method in which the throwaway practice is not feasible at all.

Thus, in the conventional robot teaching (method) for performing the plasma spray coating, the inner surface of the combustor transition pieces is masked with double or triple layers of tape so that foreign substances do not clog the fine through-holes; then, on the layers of tape, the test specimens are paved with a space of approximately five centimeters between a piece (specimen) and the adjacent piece (specimen), the test specimens being made of the same material as that of the combustor transition pieces; further, the trailer parts (end edge areas) of the test specimens are fixed to the layers of tape (the masking tape), by use of the tape of the same material as that of the layer tape (the masking tape); then, the plasma spray coating test is performed so as to execute the robot teaching.

In addition, the tape can be, for example, PTFE tape that is made of fiber glass impregnated with polytetrafluoroethylene resin, one side of the tape having an adhesive coating of silicon (silicon-base material); or, the tape can be the tape comprising silicon rubber, aluminum foil and fiber glass, the tape material being able to be used for the plasma spraying.

Further, the patent reference 3 (JP1993-111666) discloses a masking method for forming a (hard) resist film on the to-be-plasma-splayed area on which the hardened film can be formed by use of a method such as photo-curing or heat curing, the film being made of resin that is able to be resistant against plasma spraying (heat) as well as to be removed after plasma alloy spraying, the resin being applied or printed on the to-be-plasma-splayed area in a liquid condition, dried on the area and hardened by light or heat.

As for the above-described robot teaching (method) by use of the test specimens fixed on the to-be-plasma-sprayed (metal) part with the layers of tape, the plasma spraying heat sometimes scorch the tape in the test plasma spraying; thus, the surface of the metal part is exposed and plasma material clogs the fine through-holes of the tested part. Further, the heat scorches the tape fixing the pieces so that the test specimens sometimes move from the predetermined positions or the TBC plasma spray reaches the backside of the tested part. Moreover, the masking method by use of the tape is so difficult that even skilled craftsmen need a lot of man-hours to perform the method.

Even if the masking method accompanies the approach for forming a (hard) resist film on the to-be-plasma-splayed area of the inner surface of the transition piece as disclosed by the patent reference 3, it is necessary to use the tape to fix the test specimens; thus, the problem that the tape may be scorched remains unsolved.

DISCLOSURE OF THE INVENTION

In view of the hitherto unsolved subjects as described above, the present invention aims at providing a plasma spray coating method whereby the masking work is easily performed, and the conditions as to the plasma spray coating can be established so that the test specimens are surely placed on the surface of the to-be-plasma-sprayed apparatus.

In order to solve the above subjects, the present invention discloses a plasma spray coating method for forming a thermal barrier coating by performing a plasma spraying on a metal surface of heat resistant apparatus, the method comprising:

- the step of establishing the plasma spraying conditions that sequentially includes the processes of:
  - forming a heat resistant resin coating film on the whole metal surface to be plasma-sprayed,
  - placing test specimens made of the same material as the material of the heat resistant apparatus so that the specimens stick to the heat resistant apparatus,
  - plasma-spraying the thermal barrier coating material on the surface of the test specimens,
  - removing the test specimens from the heat resistant resin coating film, and confirming the plasma spraying conditions so as to establish a production plasma spraying conditions; and
- the step of forming the thermal barrier coating by plasma-spraying the thermal barrier coating material on the metal surface under the established conditions regarding the plasma spraying.

Incidentally, the to-be-plasma-sprayed surface is heated up to a temperature level of 150 to 200° C. at most; thus, the resin cured with dry air, the resin cured with light such as the resin cured with ultraviolet rays, or the resin cured with heat can be used, for example, in the above method, thereby the resin can form a hardened film from a liquid state. Moreover, an inexpensive resin such as silicon sealant that can form nonflammable filler can be used.

According to the method as disclosed above, a heat resistant resin coating film is formed on the metal surface to be plasma-sprayed as to the heat resistant apparatus; thus, the formed heat resistant resin coating film prevents the thermal barrier coating from being formed on the metal surface of the heat resistant apparatus during the trial plasma spray coating for establishing the conditions regarding the plasma spraying; further, the heat resistant resin has the heat resistant properties so that the resin is free from scorching or melting during the plasma spraying test (robot teaching). Moreover, the work for forming the heat resistant resin coating film can be performed in a relatively brief period of time; accordingly, the time needed for establishing the plasma spraying conditions can be reduced.

Preferably in the above-described disclosure, the present invention further provides the plasma spray coating method whereby the heat resistant resin coating film is made of a resin cured with ultraviolet rays in a liquid state, the ultraviolet rays being a photo-curing resin that makes the resin cure by polymerization in response to the specific wavelength of the rays; the liquid resin cured with ultraviolet rays is applied to the whole metal surface to be plasma-spray-coated; the test specimens are placed on the resin cured with ultraviolet rays and the resin is radiated with ultraviolet rays so as to be hardened; the hardened resin forms a resin film covering the metal surface, and the test specimens are bonded to the resin film.

In addition, the resin cured with ultraviolet rays or visible light can be used, thereby the resin in which the polymerization reaction in the resin has proceeded to a 10% level of the full polymerization (before being coated) is used so that the polymerization hardening speed is restrained. Further, in the embodiment described later, the resin cured with ultraviolet rays will be focused on; however, the present invention is not limited to the resin cured with ultraviolet rays. The resin cured with visible light can be also applied to the present invention; in the resin cured with light, the polymerization hardening reaction proceeds by not only ultraviolet rays but also visible light out of the ultraviolet zone. It is noted that the (light) sensitizing agent that absorbs larger energy in the visible light zone is combined with the light polymerization initiator agent that reacts to electron beams or ultraviolet rays, in the resin cured with light. The present invention may use the resin cured with the light which promotes the polymerization reaction in the resin even though the light is out of visible zone.

The ultraviolet curing resin in a liquid state may be applied to the to-be-applied surface, and ultraviolet rays may be radiated to the surface; thus, the resin film can be simply formed in a short time. In addition, by radiating ultraviolet rays after placing the test specimens on the ultraviolet curing resin in the liquid state, the test specimens are bonded to the metal surface via the hardened ultraviolet curing resin; thus, the test specimens can be simply arranged.

In addition, the radiated ultraviolet rays cannot penetrate through the test specimens; thus, the ultraviolet curing resin on the backside of the test specimens remains not in a hardened state but in a liquid state, even after radiating ultraviolet rays. The ultraviolet curing resin has weak adhesion properties; thus, there is no apprehension that the test specimens come off from the coated resin film, even though the metal surface on which the test specimens are placed is extended to the upper side area, the left and right side area, and the bottom side area of the inner space of the heat resistant apparatus such as the transition piece of the gas turbine.

Preferably in the above-described disclosure, the present invention further provides the plasma spray coating method whereby the metal that forms the heat resistant apparatus is provided with a plurality of fine through-holes; the thermal barrier coating is formed in the process of forming the heat resistant resin coating film (in the step of establishing the plasma spraying conditions), under the condition that the penetrating holes are filled with the heat resistant resin.

According to the above, the fine through-holes are free from being clogged during the blast finishing process (the abrasive blasting process) or the undercoat treatment process for the metal surface, either of the processes being performed prior to the plasma spray coating process.

Preferably in the above-described disclosure, the present invention further provides the plasma spray coating method whereby the heat resistant resin comprises an incombustible (a nonflammable) filler of the size not exceeding the (minimum) diameter of the penetrating holes.

According to the above, an incombustible (a nonflammable) filler of the size not exceeding the (minimum) diameter of the penetrating holes can be used. Since the holes are filled with the filler during the plasma spraying process or the abrasive blasting process, the holes are finally free from being clogged with the metal powders or the like.

Preferably in the above-described disclosure, the present invention further provides the plasma spray coating method whereby the test specimens are provided with at least one groove on the specimen surface that faces the heat resistant resin coating film.

According to the above, the test specimens are provided with at least one groove on the backside of the specimens, the backside facing the weakly adhesive resin film; thus, there is no apprehension that the test specimens fall off from the resin film, even though the air or the monomer gas included in the resin on the backside of the test specimens expands so as to separate the specimens from the film, as the expanded air or gas is absorbed in the air of the groove space. Or the expanded air or gas is discharged out of the groove in a case where the groove reaches the end side of the specimen so as to be open toward the outside.

According to the present invention as described above, the masking of the surface to be plasma spray-coated of the to-be-manufactured part (the to-be-plasma-sprayed apparatus) is easily performed; further, the conditions as to the plasma spray coating can be established on the premise that the plasma spraying is performed on the surface of the to-be-manufactured part, the test specimens being surely placed on the masking film on the to-be-plasma-sprayed surface of the part (apparatus).

BRIEF DESCRIPTION OF THE DRAWINGS

The present invention will now be described in greater detail with reference to the preferred embodiments of the invention and the accompanying drawings, wherein.

DETAILED DESCRIPTION OF THE PREFERRED EMBODIMENTS

Hereafter, the present invention will be described in detail with reference to the embodiments shown in the figures. However, the dimensions, materials, shape, the relative placement and so on of a component described in these embodiments shall not be construed as limiting the scope of the invention thereto, unless especially specific mention is made.

(First Embodiment)

The gas turbine comprises three components: a compressor of at least one stage, a turbine of at least one stage, and a plurality of combustors; wherein, the air compressed by the compressor is supplied to the combustor into which fuel is controllably sprayed so that the combustion of the fuel generates combustion gas of a high pressure and a high temperature; the generated combustion gas is supplied to the turbine of a centrifugal, an axial or radial type so as to rotate the gas turbine. In order to enhance the thermal efficiency of the gas turbine configured as described above, it is preferable to enhance the turbine inlet temperature (the gas inlet temperature) to as high a degree of temperature as possible; the turbine inlet (gas) temperature reaches a level within a temperature range from 1300 to 1500° C. during the operation of an industrial gas turbine.

In the gas turbine, the transition piece that leads the combustion gas in to the turbine is exposed to the high pressure combustion gas of a high temperature from 1300 to 1500° C.; thus, the inner surface of the transition piece is provided with the thermal barrier coating (TBC) to ensure the durability of the transition piece. However, the TBC sometimes falls off in a case where the operation hours of the gas turbine reach certain duration in time. Thus, it becomes necessary to provide the thermal barrier coating again, at regular time intervals or every time when the TBC falls off; in a case where the TBC is performed again, a robot comprising a plasma spray gun is used in order that the coating material is sprayed from the spray gun toward the to-be-coated surface or the whole surface of the to-be-coated part (apparatus) in response to the predetermined plasma spray conditions, while the robot is moved toward a predetermined direction at a predetermined speed. The referred plasma spray conditions depends on the shape and the material of the to-be-coated part, and so on; thus, before performing the spray coating by use of the robot, it becomes necessary to instill (teach) how to spray plasma coating in (to) the robot. It is hereby noted that the term "(robot) teaching" means to teach the robot how to move and work in this specification.

By use of FIG. 3, how to establish the plasma spraying conditions is now be explained with reference to FIGS. 1, 2 and 4.

Figure 1:
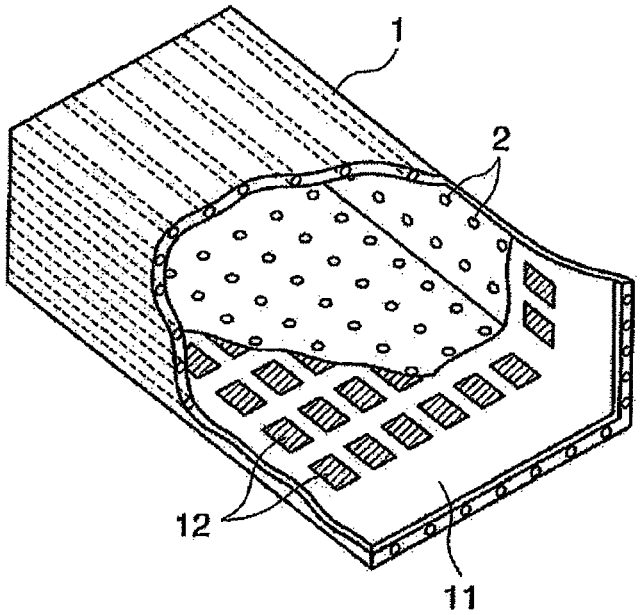
FIG. 1 shows a part of the bird view as to a transition piece of the gas turbine according to a first embodiment of the present invention, the plasma spray coating being performed on the inner surface of the transition piece.

FIG. 1 shows a part of the bird view as to the transition piece of the gas turbine according to the first embodiment of the present invention, the plasma spray coating being performed on the inner surface of the transition piece.

As shown in FIG. 1, the transition piece 1 is provided with a large number of fine through-holes 2 (e.g. for cooling the combustion gas flow film or the resin film). A heat-resistant thin coating (resin film) 11 and a test specimen 12 are explained later. In addition, the transition piece 1 is made of a nickel-base alloy.

Figure 2:
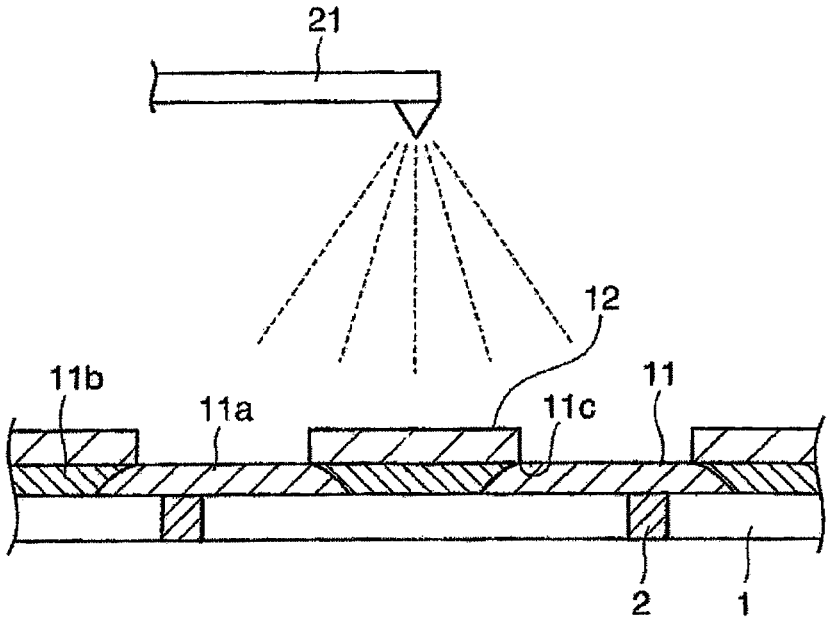
FIG. 2 shows a part of the outline cross-section as to a neighborhood area of the to-be-plasma-coated surface in establishing the plasma spray conditions.

FIG. 2 shows a part of the outline cross-section as to a neighborhood area of the to-be-plasma-coated surface in establishing the plasma spray conditions; FIG. 3 shows a flow chart for establishing the plasma spray conditions as well as performing the plasma spray coating as per the established conditions.

FIG. 4(A) shows a side view of the test specimen 12 explained later; FIG. 4(B) shows an A-A cross-section of FIG. 4(A). As shown in FIGS. 4(A) and 4(B), the test specimen 12 is provided with a groove 12*a* of a U-shaped cross section.

The plasma spray coating is performed as per the established plasma spray conditions, after the transition piece 1 is removed from the gas turbine that is in a shutdown state and sufficiently cooled.

Figure 3:
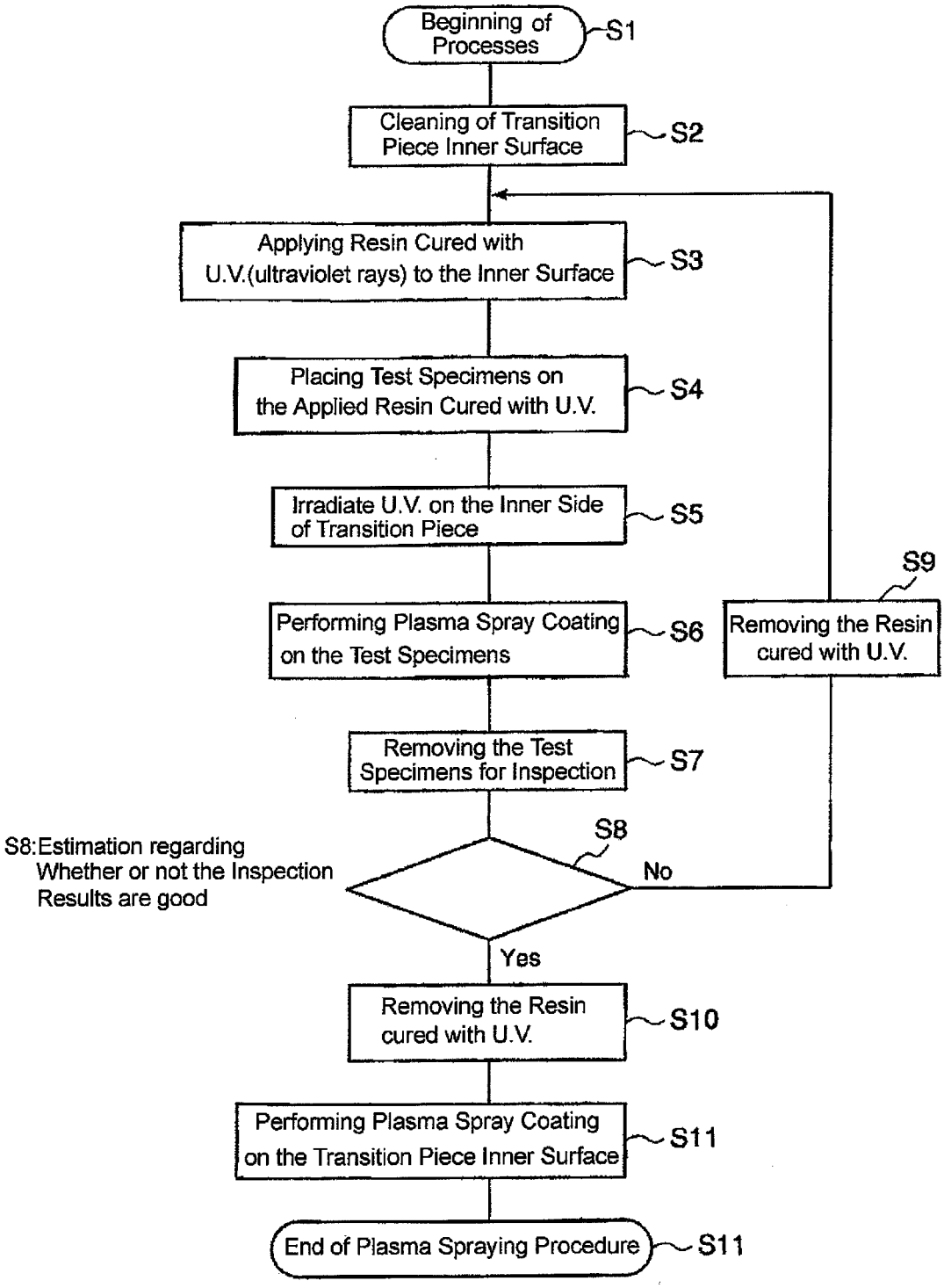
FIG. 3 shows a flow chart for establishing the plasma spray conditions as well as performing the plasma spray coating as per the established conditions.
Figure 4:
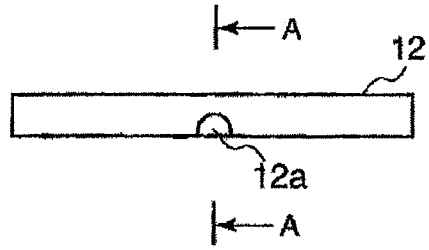
FIG. 4(A) shows a side view of a test specimen.
FIG. 4(B) shows an A-A cross-section of FIG. 4(A).
Figure 4:
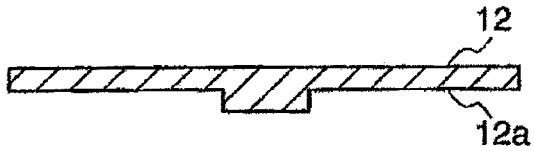

In the flow chart of FIG. 3, the step S1 denotes the beginning of the processes as to the plasma spray coating; in the next step S2, the inner surface of the transition piece 1 is cleaned. In cleaning the surface, no special conditions may be required so long as neither the transition piece 1 is damaged nor the inner surface is deteriorated; a worker may clean the inner surface in the transition piece 1 either by hand or by use of a high-pressure water-jet.

When the step S2 of cleaning the inner surface is finished, the step 2 is followed by the step S3 where a liquid ultraviolet curing resin (a liquid resin cured with ultraviolet radiation) is applied to the inner surface of the transition piece 1 with a brush so that the resin forms a film of a thickness from 100 to 200 μm; the ultraviolet curing resin can be commercially available; for example, a resin of the trade name "SpeedMASK" produced by Dymax Corporation can be used as the resin of this kind.

Further, instead of the above-described ultraviolet curing resin, a resin that can form a hardened film from a liquid state may also be used in the step S3; namely, the resin may be cured with dry air, cured with light, or cured with heat. Moreover, the heat resistant material, namely, a heat resistant silicon sealant that can form nonflammable filler made of a material such as mica may be used; thereby, the size regarding the clusters of the heat resistant silicon sealant may be less than the diameter of the fine through-holes.

Incidentally, it is required that the resin cured with ultraviolet radiation be not burnt by the heat during the plasma spraying; the explanation will be given later about the detail as to the plasma splaying.

After the ultraviolet curing resin is applied on the inner surface of the transition piece in the step S3, the test specimens 12 are placed on the applied liquid resin (the ultraviolet curing resin) in the step S4. In the present embodiment, the material of the test specimens 12 is the same as the material of the transition piece; namely, the material is a nickel-base alloy; and, the size of the specimen 12 is 100 mm in length, 50 mm in width and 1 mm in thickness; further, the specimens are paved on the inner surface of the transition piece 1 with a space of 50 mm between a specimen and the adjacent specimen.

Further, it is required that the area (footprints) and the number of the test specimens 12 placed on the inner surface (the surface of the ultraviolet curing resin applied on the inner side of the transition piece) be arranged so that the plasma spraying conditions can be confirmed over the whole inner surface of the transition piece 1.

After the test specimens are placed in the step S4, the step S4 is followed by the step S5 where at least one ultraviolet lamp is located in the inner space of the transition piece 1 and ultraviolet rays are radiated toward the surface of the ultraviolet curing resin applied on the inner side of the transition piece; and, the ultraviolet curing resin is hardened so as to form a heat-resistant (thin coating) film 11.

With reference to FIG. 2, the hardening of the ultraviolet curing resin is now explained. Being radiated with the ultraviolet rays, the ultraviolet curing resin is hardened at the area 11*a* where the test specimens 12 are not placed. On the other hand, the ultraviolet curing resin is not hardened at the area facing the backside 11*b* of the test specimens 12, as the test specimens made of the nickel-base alloy cutoff the ultraviolet rays. Further, as shown in FIG. 2, the ultraviolet rays enter the resin that is beneath the test specimens (the area 11*b* facing the backside of the specimens) as well as in the neighborhood of the end sides of the test specimens (the area within approximately 2 mm from the end sides); and, the resin which the ultraviolet rays enter is also hardened. Thereby, a plurality of adhesion parts 11*c* where the test specimens adhere to the ultraviolet curing resin film 11 is formed along the end sides of the test specimens 12.

Thus, the heat-resistant (thin coating) film 11 is formed at the area 11*a* where the test specimens 12 are not placed; further, the test specimens 12 are bonded (connected) to the inner surface of the transition piece 1 via the adhesion parts 11*c* and the heat-resistant (thin coating) film 11.

The test specimens are placed on the whole areas of the inner surface of the transition piece 1, namely on the upper area, the lower area and the side area of the inner surface; the test specimens do not fall off, even when the specimens are placed on the upper area or the side area, as there is non-hardened resin on the backside of the specimens and the ultraviolet curing resin (e.g. "SpeedMASK" produced by Dymax Corporation) has adhesion properties, though weak.

In a case where fluid resin capable of forming hardened coating film other than the ultraviolet curing resin is used, the hardened film is formed in this step S5.

After the heat-resistant (thin coating) film 11 is formed by radiating ultraviolet rays in the inner side of the transition piece 5 in the step S5, the step S5 is followed by the step S6 where the robot teaching is performed toward a robot (not shown) equipped with a thermal spraying gun 21; further, in the step S6, the trial plasma spray coating is performed under the robot teaching conditions (i.e. the conditions that is instilled in the robot) like the production plasma spray coating is performed. More concretely in this embodiment, an under-coating layer made of a CoNiCrAlY alloy is formed throughout the whole inner surface of the transition piece 1, by a plasma spraying in which the plasma spraying temperature does not exceed 300° C., after an abrasive blasting (process) is performed on the inner surface. Further, a top-coating layer of a 500 to 700 μm thickness made of $ZrO_2$ and $8Y_2O_3$ is formed over the whole inner surface of the transition piece 1, by a plasma spraying in which the plasma spraying temperature does not exceed 300° C. During the plasma spraying process, the distance between the thermal spraying gun 21 and the test specimen is to be approximately 100 mm.

There is an apprehension that the air or the monomer gas included in the resin on the backside 11*b* of the test specimens 12 expands because of the heat by plasma-spraying and the expanded air or gas makes the test specimen fall off from the resin film; thus, the test specimen 12 is provided with at least one groove 12*a* of a U-shaped cross-section as depicted in FIGS. 4(A) and 4(B), so that the expanded air or gas can be discharged outside. In this way, the apprehension regarding the separation of the specimen 12 is eliminated.

Moreover, as depicted in FIG. 2, the fine through-holes 2 are filled with the ultraviolet curing resin; therefore, there is no apprehension that the fine holes are clogged with the alloy materials or the metals (slug) during the under-coating treatment or the abrasive blasting process.

After the trial plasma spray coating is performed in the step S6, the step S6 is followed by the step 7 where the test specimens 12 are peeled off, and the transition piece 1 and the plasma spray state (the plasma sprayed results) on the specimens 12 is examined. Since the specimens are bonded to the inner surface of the transition piece 1 by the week adhesion properties of the ultraviolet curing resin via the heat-resistant thin coating film 11 on the backside of the specimens, the test specimens 12 can be peeled off by hand. In examining the test specimens 12, it is checked whether or not the plasma spray condition at each location on the inner surface of the transition piece is satisfactory in view of the plasma coating requirements (or predetermined specifications).

After the examination has been performed in the step S7, the step S7 is followed by the step S8 where it is decided whether the process returns back to the step S3 via the step S9 or goes to the step S10. If the examination result is not satisfactory, the step S8 is followed by the step S9 where the ultraviolet curing resin on the inner surface of the transition piece 1 is removed. Further, the plasma spraying conditions are changed (adjusted) and the process returns back to the step S3 from the step S9; namely, the process loop passing the steps S3, S8, and S9 is repeated till the examination result is judged to be satisfactory in the step S8 and proper plasma spraying conditions are established.

If the examination result is satisfactory in the step S8, the step S8 is followed by the step S10 where the ultraviolet curing resin is removed. Further, the plasma spraying conditions for the robot teaching is established as per the conditions which are (finally) used in the step S6. Then, in the following step S11, the production plasma spray coating for the inner surface of the transition piece 1 is performed according to the established plasma spraying conditions (instilled in the robot). After the step S11, the plasma spraying procedure finishes in the step S12.

In addition, it is most advantageous to remove the ultraviolet curing resin by hand or by use of a spatula in the steps S9 and S10. In a case where the ultraviolet curing resin cannot be sufficiently removed, the resin may be removed by burning the resin or by dissolving the resin with a suitable solvent. Further, in a case where the resin can be easily taken off from the metal surface after being hardened, the resin may be removed by hand.

Further, in the step S11, the fine through-holes that are (if any) not clogged by the suitable clogging materials are filled with the resin; then, the plasma spraying is performed under the condition that the whole fine holes are filled with the resin or the suitable clogging materials. Since the transition piece is placed into an active combustion test after the production plasma spray coating is completed and the resin or the suitable clogging materials are burnt off, there is no apprehension that the resin or the suitable clogging materials remain in some of the fine through-holes. In other words, there is no apprehension that the diameters of the fine holes decrease because of the plasma spraying material adhesion, as the resin or the suitable clogging materials left in the fine holes hinder the plasma spraying material from entering the fine holes; and the resin or the suitable clogging materials are burnt off due to the high temperature of the combustion gas.

According to the above-described embodiment, the coating film of the ultraviolet curing resin can be easily formed on the metal surface at the inner side of the transition piece that is the to-be-plasma-sprayed subject; moreover, the plasma spray coating can be performed on the inner surface of the transition piece, under predetermined plasma spraying conditions.

Industrial Applicability

According to the present invention, a plasma spray coating method for forming a plasma spray coating film on the surface of the part (member) of an industrial products can be provided whereby the masking of the surface to be plasma spray-coated of the to-be-manufactured part is easily performed, and the conditions as to the plasma spray coating can be established on the premise that the plasma spraying is performed on the surface of the test specimens surely placed on the masking film on the to-be-plasma-sprayed surface of the part.

The invention claimed is:

1. A plasma spray coating method for forming a thermal barrier coating by performing a plasma spraying on a metal surface of a heat resistant apparatus, the method comprising:

establishing plasma spraying conditions, wherein said establishing sequentially includes:

(a) applying a resin to be cured with light in a liquid state on the whole metal surface to be plasma-sprayed, (b) placing test specimens made of the same material as the material of which the heat resistant apparatus is made on the resin to be cured with light, and then radiating the resin with light so as to cure the resin, such that the curing forms a heat resistant resin coating film covering the metal surface and the curing bonds the test specimens to the heat resistant resin coating film, (c) plasma-spraying a thermal barrier coating material on surfaces of the test specimens bonded to the heat resistant resin coating film, (d) removing the test specimens from the heat resistant resin coating film, and confirming the plasma spraying conditions so as to establish production plasma spraying conditions, (e) removing the heat resistant resin coating film from the metal surface, and then forming the thermal barrier coating by plasma-spraying the thermal barrier coating material on the metal surface under the established production plasma spraying conditions.

2. The plasma spray coating method according to claim 1, wherein a material that forms the heat resistant apparatus is provided with a plurality of penetrating through-holes; and the heat resistant resin coating film is formed such that the penetrating through-holes are filled with heat resistant resin, and when plasma-spraying the thermal barrier coating material onto the surfaces of the test specimens, the penetrating through-holes are filled with the heat resistant resin.

3. The plasma spray coating method according to claim 2, wherein the heat resistant resin comprises an incombustible filler of a size not to exceed the minimum diameter of the penetrating through-holes.

4. The plasma spray coating method according to claim 1, wherein at least one of the test specimens has at least one groove on a surface that faces the heat resistant resin coating film.

* * * * *